United States Patent [19]

Lisle et al.

[11] Patent Number: 5,054,360

[45] Date of Patent: Oct. 8, 1991

[54] METHOD AND APPARATUS FOR SIMULTANEOUS OUTPUT OF DIGITAL AUDIO AND MIDI SYNTHESIZED MUSIC

[75] Inventors: Ronald J. Lisle, Cedar Park; B. Scott McDonald, Leander; Michael D. Wilkes, Austin, all of Tex.

[73] Assignee: International Business Machines Corporation, Armonk, N.Y.

[21] Appl. No.: 608,111

[22] Filed: Nov. 1, 1990

[51] Int. Cl.[5] ..... G10H 7/00

[52] U.S. Cl. ..... 84/645

[58] Field of Search ..... 84/645

[56] References Cited

U.S. PATENT DOCUMENTS 4,942,551 7/1990 Klappert et al. ..... 84/645 X

*Primary Examiner*—Stanley J. Witkowski

*Attorney, Agent, or Firm*—Andrew J. Dillon

[57] ABSTRACT

A method and apparatus are disclosed for simultaneously outputting digital audio and MIDI synthesized music utilizing a single digital signal processor. The Musical Instrument Digital Interface (MIDI) permits music to be recorded and/or synthesized utilizing a data file containing multiple serially listed program status messages and matching note on and note off messages. In contrast, digital audio is generally merely compressed, utilizing a suitable data compression technique, and recorded. The audio content of such a digital recording may then be restored by decompressing the recorded data and converting that data utilizing a digital-to-analog convertor. The method and apparatus of the present invention selectively and alternatively couples portions of a compressed digital audio file and a MIDI file to a single digital signal processor which alternately decompresses the digital audio file and implements a MIDI synthesizer. Decompressed audio and MIDI synthesized music are then alternately coupled to two separate buffers. The contents of these buffers are then additively mixed and coupled through a digital-to-analog convertor to an audio output device to create an output having concurrent digital audio and MIDI synthesized music.

8 Claims, 3 Drawing Sheets

METHOD AND APPARATUS FOR SIMULTANEOUS OUTPUT OF DIGITAL AUDIO AND MIDI SYNTHESIZED MUSIC

BACKGROUND OF THE INVENTION

1. Technical Field

The present invention relates in general to the field of digital audio systems and in particular to systems which include MIDI synthesizers implemented utilizing a digital signal processor. Still more particularly, the present invention relates to a method and apparatus for simultaneously outputting both digital audio and MIDI synthesized music utilizing a single digital processor.

2. Description of the Related Art

MIDI, the "Musical Instrument Digital Interface" was established as a hardware and software specification which would make it possible to exchange information such as: musical notes, program changes, expression control, etc. between different musical instruments or other devices such as: sequencers, computers, lighting controllers, mixers, etc. This ability to transmit and receive data was originally conceived for live performances, although subsequent developments have had enormous impact in recording studios, audio and video production, and composition environments.

A standard for the MIDI interface has been prepared and published as a joint effort between the MIDI Manufacturer's Association (MMA) and the Japan MIDI Standards Committee (JMSC). This standard is subject to change by agreement between JMSC and MMA and is currently published as the MIDI 1.0 Detailed Specification, Document Version 4.1, January 1989.

The hardware portion of the MIDI interface operates at 31.25 KBaud, asynchronous, with a start bit, eight data bits and a stop bit. This makes a total of ten bits for a period of 320 microseconds per serial byte. The start bit is a logical zero and the stop bit is a logical one. Bytes are transmitted by sending the least significant bit first. Data bits are transmitted in the MIDI interface by utilizing a five milliamp current loop. A logical zero is represented by the current being turned on and a logical one is represented by the current being turned off. Rise times and fall times for this current loop shall be less than two microseconds. A five pin DIN connector is utilized to provide a connection for this current loop with only two pins being utilized to transmit the current loop signal. Typically, an opto-isolater is utilized to provide isolation between devices which are coupled together utilizing a MIDI format.

Communication utilizing the MIDI interface is achieved through multi-byte "messages" which consist of one status byte followed by one or two data bytes. There are certain exceptions to this rule. MIDI messages are sent over any of sixteen channels which may be utilized for a variety of performance information. There are five major types of MIDI messages: Channel Voice; Channel Mode; System Common; System Real-Time; and, System Exclusive. A MIDI event is transmitted as a message and consists of one or more bytes.

A channel message in the MIDI system utilizes four bits in the status byte to address the message to one of sixteen MIDI channels and four bits to define the message. Channel messages are thereby intended for the receivers in a system whose channel number matches the channel number encoded in the status byte. An instrument may receive a MIDI message on more than one channel. The channel in which it receives its main instructions, such as which program number to be on and what mode to be in, is often referred to as its "Basic Channel." There are two basic types of channel messages, a Voice message and a Mode message. A Voice message is utilized to control an instrument's voices and Voice messages are typically sent over voice channels. A Mode message is utilized to define the instrument's response to Voice messages, Mode messages are generally sent over the instrument's Basic Channel.

System messages within the MIDI system may include Common messages, Real-Time messages, and Exclusive messages. Common messages are intended for all receivers in a system regardless of the channel that receiver is associated with. Real-Time messages are utilized for synchronization and are intended for all clock based units in a system. Real-Time messages contain status bytes only, and do not include data bytes. Real-Time messages may be sent at any time, even between bytes of a message which has a different status. Exclusive messages may contain any number of data bytes and can be terminated either by an end of exclusive or any other status byte, with the exception of Real-Time messages. An end of exclusive should always be sent at the end of a system exclusive message. System exclusive messages always include a manufacturer's identification code. If a receiver does not recognize the identification code it will ignore the following data.

As those skilled in the art will appreciate upon reference to the foregoing, musical compositions may be encoded utilizing the MIDI standard and stored and/or transmitted utilizing substantially less data. The MIDI standard permits the transmittal of a serial listing of program status messages and channel messages, such as "note on" and "note off" and as a consequence require substantially less digital data to encode than the straightforward digitization of an analog music signal.

Earlier attempts at integrating music and other analog forms of communication, such as speech, into the digital computer area have traditionally involved the sampling of an analog signal at a sufficiently high frequency to ensure that the highest frequency present within the signal will be captured (the "Nyquist rate") and the subsequent digitization of those samples for storage. The data rate required for such simple sampling systems can be quite enormous with several tens of thousands of bits of data being required for each second of audio signal.

As a consequence, many different encoding systems have been developed to decrease the amount of data required in such systems. For example, many modern digital audio systems utilize pulse code modulation (PCM) which employs a variation of a digital signal to represent analog information. Such systems may utilize pulse amplitude modulation (PAM), pulse duration modulation (PDM) or pulse position modulation (PPM) to represent variations in an analog signal.

One variation of pulse code modulation, Delta Pulse Code Modulation (DPCM) achieves still further data compression by encoding only the difference between one sample and the next sample. Thus, despite the fact that an analog signal may have a substantial dynamic range, if the sampling rate is sufficiently high so that adjacent signals do not differ greatly, encoding only the difference between two adjacent signals can save substantial data. Further, adaptive or predictive techniques are often utilized to further decrease the amount of data necessary to represent an analog signal by attempting to predict the value of a signal based upon a weighted sum of previous signals or by some similar algorithm.

In each of these digital audio techniques speech or an audio signal may be sampled and digitized utilizing straightforward processing and digital-to-analog or analog-to-digital conversion techniques to store or recreate the signal.

While the aforementioned digital audio systems may be utilized to accurately store speech or other audio signal samples a substantial penalty in data rates must be paid in order to achieve accurate results over that which may be achieved in the music world with the MIDI system described above. However, in systems wherein it is desired to recreate human speech there exists no appropriate alternative in the MIDI system for the reproduction of human speech.

Thus, it should be apparent that a need exists for a method and apparatus whereby certain digitized audio samples, such as human speech, may be recreated and combined with synthesized music which was created or recreated utilizing a MIDI data file.

Further, it would be extremely advantageous to be able to accomplish this task with a single digital processor.

SUMMARY OF THE INVENTION

It is therefore one object of the present invention to provide an improved digital audio system.

It is another object of the present invention to provide an improved digital audio system which includes a MIDI synthesizer implemented utilizing a digital signal processor.

It is yet another object of the present invention to provide an improved method and apparatus for simultaneously outputting both digital audio and MIDI synthesized music utilizing a single digital processor.

The foregoing objects are achieved as is now described. The Musical Instrument Digital Interface (MIDI) permits music to be recorded and/or synthesized utilizing a data file containing multiple serially listed program status messages and matching note on and note off messages. In contrast, digital audio is generally merely compressed, utilizing a suitable data compression technique, and recorded. The audio content of such a digital recording may then be restored by decompressing the recorded data and converting that data utilizing a digital-to-analog convertor. The method and apparatus of the present invention selectively and alternatively couples portions of a compressed digital audio file and a MIDI file to a single digital signal processor which alternately decompresses the digital audio file and implements a MIDI synthesizer. Decompressed audio and MIDI synthesized music are then alternately coupled to two separate buffers. The contents of these buffers are then additively mixed and coupled through a digital-to-analog convertor to an audio output device to create an output having concurrent digital audio and MIDI synthesized music.

BRIEF DESCRIPTION OF THE DRAWING

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF PREFERRED EMBODIMENT

Figure 1:
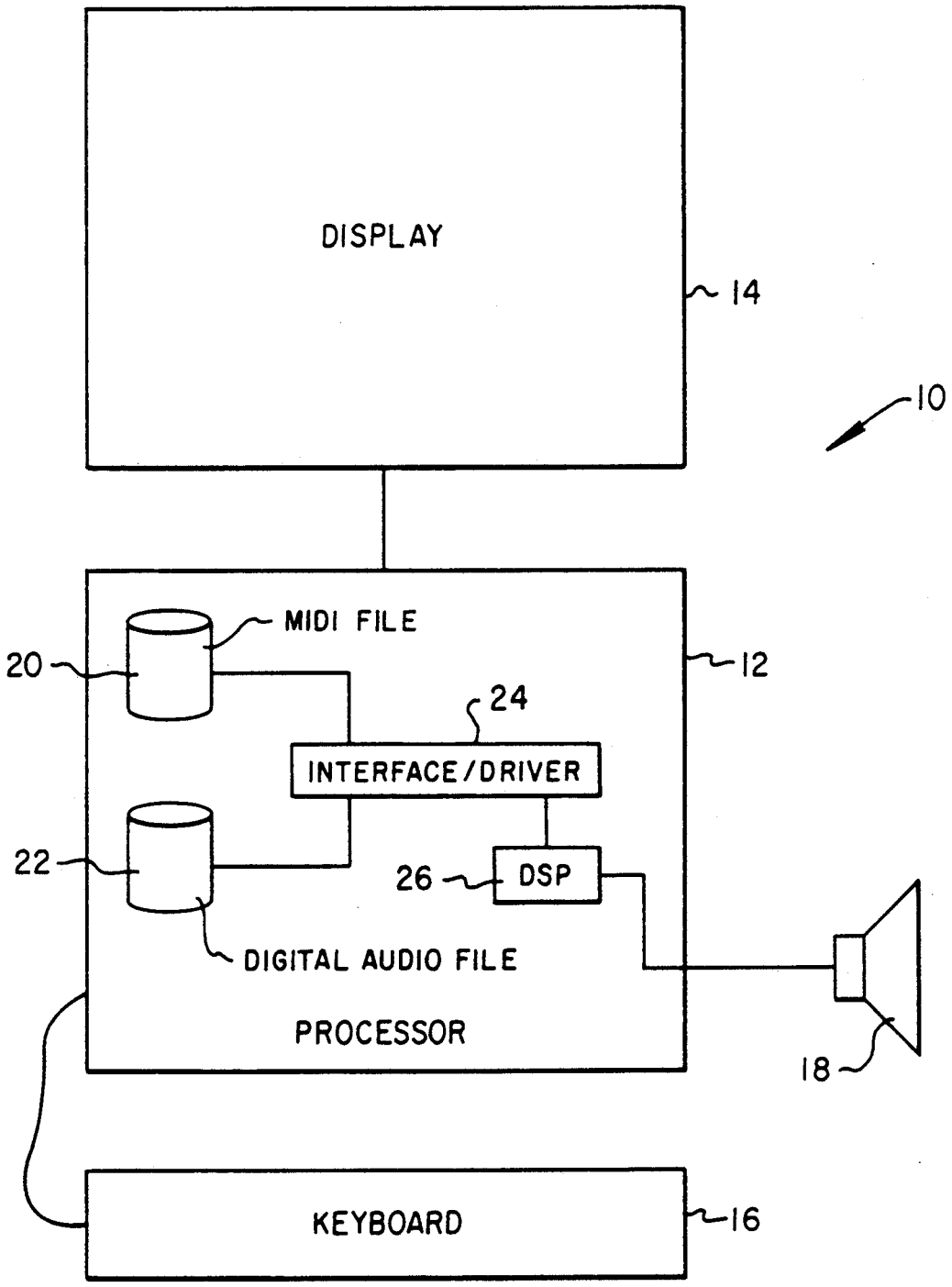
FIG. 1 is a block diagram of a computer system which may be utilized to implement the method and apparatus of the present invention.

With reference now to the figures and in particular with reference to FIG. 1, there is depicted a block diagram of a computer system 10 which may be utilized to implement the method and apparatus of the present invention. As is illustrated, a computer system 10 is depicted. Computer system 10 may be implemented utilizing any state-of-the-art digital computer system having a suitable digital signal processor disposed therein which is capable of implementing a MIDI synthesizer. For example, computer system lo may be implemented utilizing an IBM PS/2 type computer which includes an IBM Audio Capture & Playback Adapter (ACPA).

Also included within computer system 10 is display 14. Display 14 may be utilized, as those skilled in the art will appreciate, to display those command and control features typically utilized in the processing of audio signals within a digital computer system. Also coupled to computer system 10 is computer keyboard 16 which may be utilized to enter data and select various files stored within computer system 10 in a manner We)) known in the art. Of course, those skilled in the art will appreciate that a graphical pointing device, such as a mouse or light pen, may also be utilized to enter commands or select appropriate files within computer system 10.

Still referring to computer system 10, it may be seen that processor 12 is depicted. Processor 12 is preferably the central processing unit for computer system and, in the depicted embodiment of the present invention, preferably includes an audio adapter capable of implementing a MIDI synthesizer by utilizing a digital signal processor. One example of such a device is the IBM Audio Capture & Playback Adapter (ACPA).

As is illustrated, MIDI file 20 and digital audio file 12 are both depicted as stored within memory within processor 12. The output of each file may then be coupled to interface/driver circuitry 24. Interface/driver circuitry 24 is preferably implemented utilizing any suitable audio application programming interface which permits the accessing of MIDI protocol files or digital audio files and the coupling of those files to an appropriate device driver circuit within interface/driver circuitry 24.

Thereafter, the output of interface/driver circuitry 24 is coupled to digital signal processor 26. Digital signal processor 26, in a manner which will be explained in greater detail herein, is utilized to simultaneously output digital audio and MIDI synthesized music and to couple that output to audio output device 18. Audio output device 18 is preferably an audio speaker or pair of speakers in the case of stereo music files.

Figure 2:
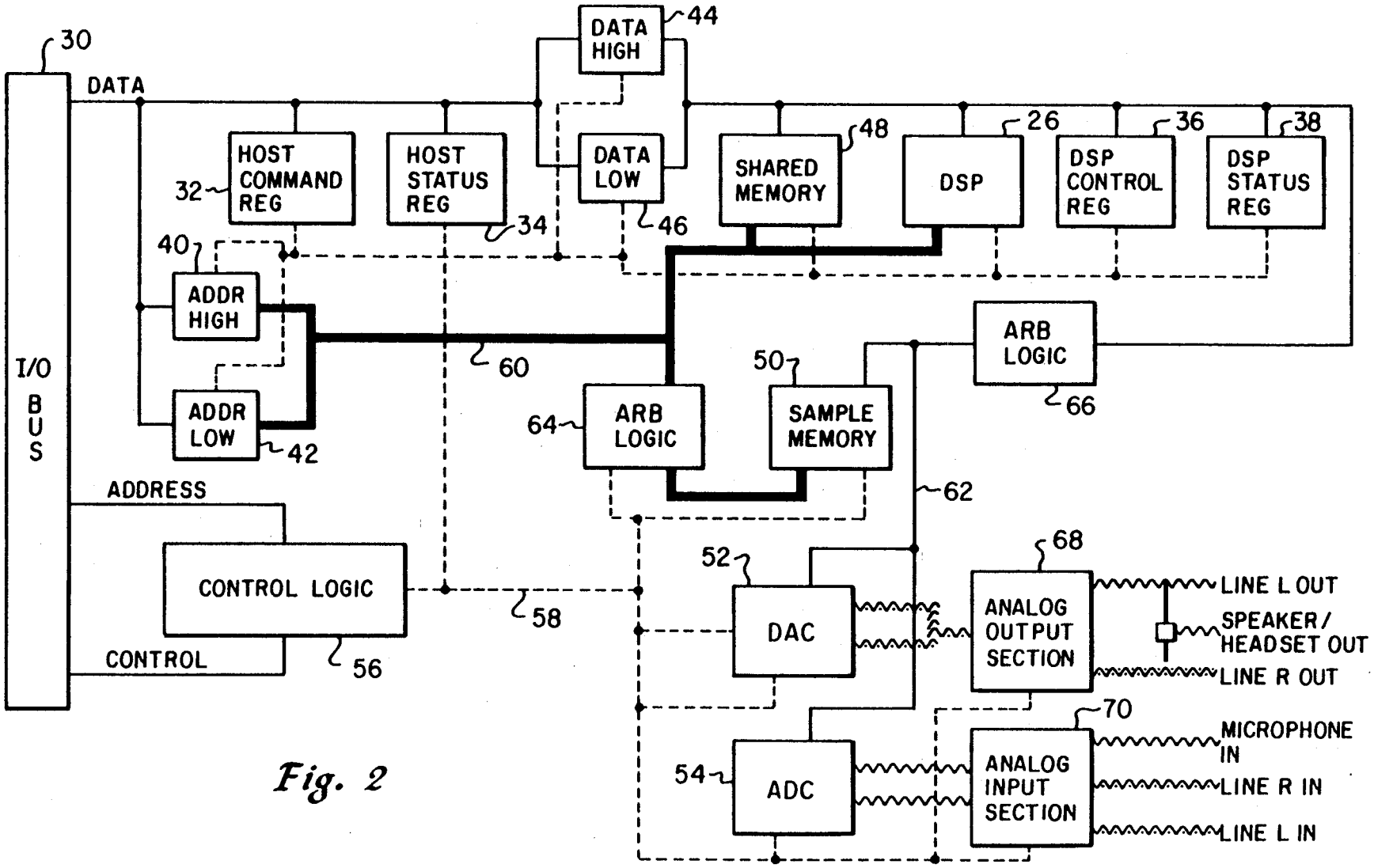
FIG. 2 is a block diagram of an audio adapter which includes a digital signal processor which may be utilized to implement the method and apparatus of the present invention.

Referring now to FIG. 2, there is depicted a block diagram of an audio adapter which includes digital signal processor 26 which may be utilized to implement the method and apparatus of the present invention. As discussed above, this audio adapter may be simply implemented utilizing the IBM Audio Capture & Playback Adapter (ACPA) which is commercially available. In such an implementation digital signal processor 26 is provided by utilizing a Texas Instruments TMS 320C25, or other suitable digital signal processor.

As illustrated, the interface between processor 12 and digital signal processor 26 is I/O bus 30. Those skilled in the art will appreciate that I/O bus 30 may be implemented utilizing the Micro Channel or PC I/O bus which are readily available and understood by those skilled in the personal computer art. Utilizing I/O bus 30, processor 12 can access the host command register 32. Host command register 32 and host status register 34 are used by processor 12 to issue commands and monitor the status of the audio adapter depicted within FIG. 2.

Processor 12 may also utilize I/O bus 30 to access the address high byte latched counter and address low byte latched counter which are utilized by processor 12 to access shared memory 48 within the audio adapter depicted within FIG. 2. Shared memory 48 is preferably an 8K×16 fast static RAM which is "shared" in the sense that both processor 12 and digital signal processor 26 may access that memory. As will be discussed in greater detail herein, a memory arbiter circuit is utilized to prevent processor 12 and digital signal processor 26 from accessing shared memory 48 simultaneously.

As is illustrated, digital signal processor 26 also preferably includes digital signal processor control register 36 and digital signal processor status register 38 which are utilized, in the same manner as host command register 32 and host status register 34, to permit digital signal processor 26 to issue commands and monitor the status of various devices within the audio adapter.

Processor 12 may also be utilized to couple data to and from shared memory 48 Via I/O bus 30 by utilizing data high byte bi-directional latch 44 and data low-byte bi-directional latch 46, in a manner well known in the art.

Sample memory 50 is also depicted within the audio adapter of FIG. 2. Sample memory 50 is preferably a 2K×16 static RAM which is utilized by digital signal processor 26 for outgoing samples to be played and incoming samples of digitized audio. Sample memory 50 may be utilized, as will be explained in greater detail herein, as a temporary buffer to store decompressed digital audio samples and MIDI synthesized music samples for simultaneous output in accordance with the method and apparatus of the present invention. Those skilled in the art will appreciate that by decompressing digital audio data and by creating synthesized music from MIDI files unit a predetermined amount of each data type is stored within sample memory 50, it will be a simple matter to combine these two outputs in the manner described herein.

Control logic 56 is also depicted within the audio adapter of FIG. 2. Control logic 56 is preferably a block of logic which, among other tasks, issues interrupts to processor 12 after a digital signal processor 26 interrupt request, controls the input selection switch and issues read, write and enable strobes to the various latches and memory devices within the audio adapter depicted. Control logic 56 preferably accomplishes these tasks utilizing control bus 58.

Address bus 60 is depicted and is preferably utilized, in the illustrated embodiment of the present invention, to permit addresses of various samples and files within the system to be coupled between appropriate devices in the system. Data bus 62 is also illustrated and is utilized to couple data among the various devices within the audio adapter depicted.

As discussed above, control logic 56 also uses memory arbiter logic 64 and 66 to control access to shared memory 48 and sample memory 50 to ensure that processor 12 and digital signal processor 26 do not attempt to access either memory simultaneously. This technique is well known in the art and is necessary to ensure that memory deadlock or other such symptoms do not occur.

Finally, digital-to-analog converter 56 is illustrated and is utilized to convert the decompressed digital audio or digital MIDI synthesized music signals to an appropriate analog signal. The output of digital-to-analog converter 52 is then coupled to analog output section 68 which, preferably includes suitable filtration and amplification circuitry. Similarly, the audio adapter depicted within FIG. 2 may be utilized to digitize and store audio signals by coupling those signals into analog input section 70 and thereafter to analog-to-digital converter 54. Those skilled in the art will appreciate that such a device permits the capture and storing of analog audio signals by digitization and storing of the digital values associated with that signal.

Figure 3:
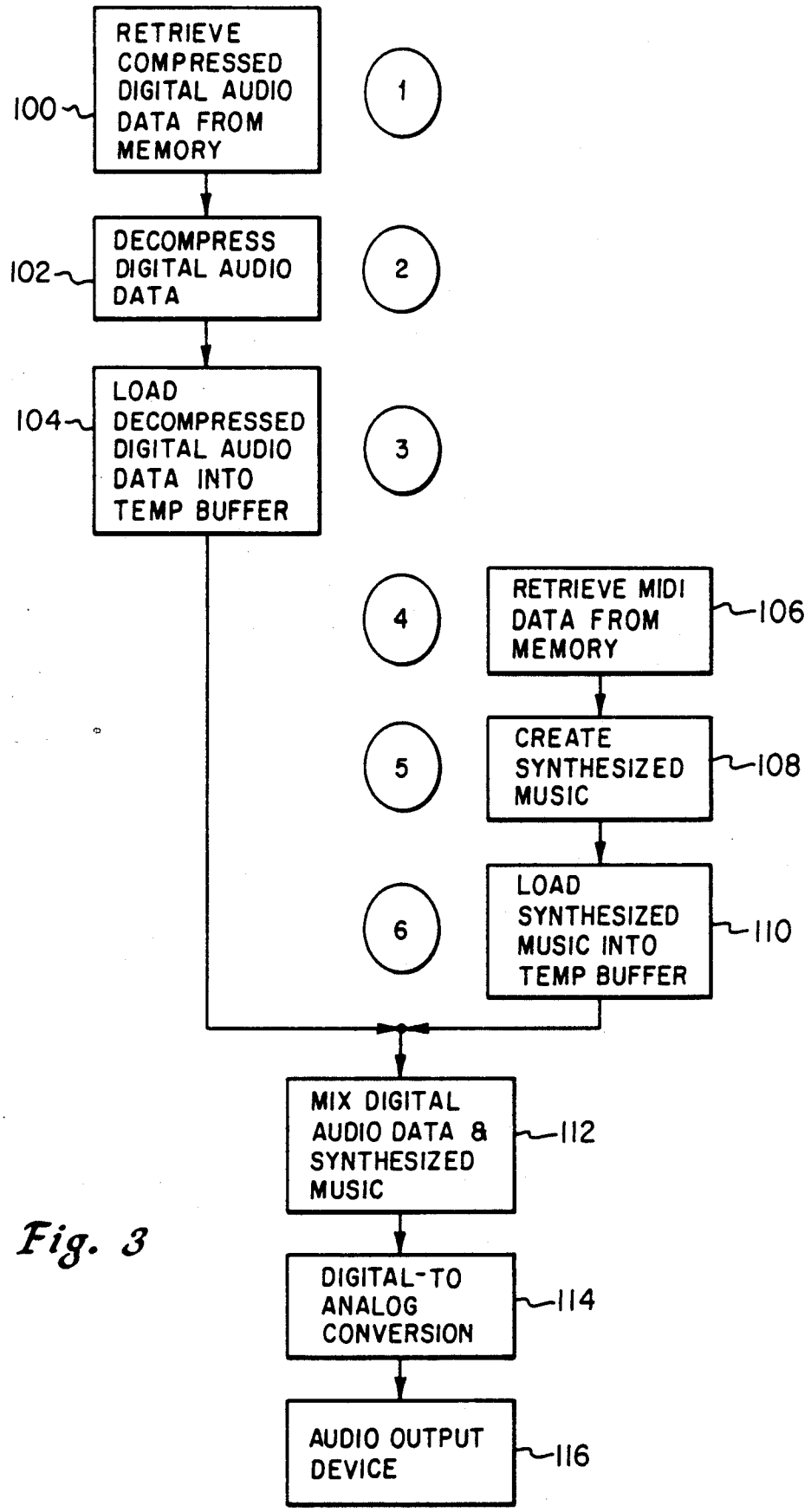
FIG. 3 is a high level flow chart and timing diagram of the method and apparatus of the present invention.

With reference now to FIG. 3, there is depicted a high level flow chart and timing diagram of the method and apparatus of the present invention. As illustrated, the process begins at block 100 which depicts the retrieving of a compressed digital audio data block from memory. Thereafter, in the sequence depicted numerically, the digital audio data is decompressed utilizing digital signal processor 26 and an appropriate decompression technique. Those skilled in the art will appreciate that the decompression technique utilized will vary in accordance with the compression technique which was utilized and variations in this technique will not depart from the spirit and intent of the present invention. Next, the decompressed digital audio data is loaded into a temporary buffer, such as sample memory 50 (see FIG. 2).

At this point, in accordance with an important feature of the present invention, digital signal processor 26 is selectively and alternatively utilized to implement a MIDI synthesizer. This process begins at block 106 which depicts the retrieval of MIDI data from memory. Next, block 108 illustrates the creation of synthesized music by coupling the various program status changes, note on and note off messages and other control messages within the MIDI data file to a digital synthesizer which may be implemented utilizing digital signal processor 26. Thereafter, the synthesized music created from that portion of the MIDI file which has been retrieved is also loaded into a temporary buffer, such as sample memory 50.

At this point, the decompressed digital audio data and the synthesized music, each having been located into a temporary buffer, are combined in an additive mixer which serves to mix the digital audio data and synthesized music so that they may be simultaneously output. The output of this additive mixer is then coupled to an appropriate digital-to-analog conversion device, as illustrated in block 114. Finally, the output of the digital-to-analog conversion device is coupled to an audio output device, as depicted in block 116.

Of course, those skilled in the art will appreciate that the illustrated embodiment is representative in nature and not meant to be all inclusive. For example, the system may be implemented with alternate timing in that MIDI data may be retrieved first followed by compressed digital audio data. Similarly, in the event eight note polyphony is desired, sufficient MIDI data must be retrieved from memory to synthesize each note which is active for the portion of synthesized music to be created. Similarly, in the event stereo music is created, various control signals such as a pan signal must also be included to ensure that the audio outputs are coupled to an appropriate speaker, with the desired amount of amplification in that channel.

Upon reference to the foregoing those skilled in the art will appreciate that the Applicants in the present application have developed a technique whereby compressed digital audio data may be decompressed and portions of that data stored within a temporary buffer while MIDI data files are accessed and utilized to create digital synthesized music in a MIDI synthesizer which is implemented utilizing the same digital signal processor which is utilized to decompress the digital audio data. By selectively and alternatively accessing these two diverse types of data and then additively mixing the two outputs, a single digital signal processor may be utilized to simultaneously output both decompressed digital audio data and MIDI synthesized music in a manner which was not heretofor possible.

While the invention has been particularly shown and described with reference to a preferred embodiment, it will be understood by those skilled in the art that various changes in form and detail may be made therein without departing from the spirit and scope of the invention.

What is claimed is:

1. A method for the simultaneous output of digital audio and MIDI synthesized music by a single digital signal processor, said method comprising the steps of:
   - storing a compressed digital audio file within a memory device associated with a single digital signal processor;
   - storing a MIDI file within a memory device associated with said single digital signal processor;
   - selectively and alternatively coupling portions of said compressed digital audio file to said single digital signal processor for creation of decompressed audio and portions of said MIDI file to said single digital signal processor for creation of MIDI synthesized music;
   - storing said decompressed digital audio within a first temporary buffer;
   - storing said MIDI synthesized music within a second temporary buffer; and
   - combining the contents of said first temporary buffer and said second temporary buffer to create a composite output including digital audio and MIDI synthesized music.

2. The method for simultaneous output of digital audio and MIDI synthesized music according to claim 1, further including the step of coupling said composite output to a digital-to-analog converter.

3. The method for simultaneous output of digital audio and MIDI synthesized music according to claim 2, further including the step of coupling an output of said digital-to-analog converter to an audio output device.

4. The method for simultaneous output of digital audio and MIDI synthesized music according to claim 1, wherein said step of selectively and alternatively coupling portions of said compressed digital audio file to said single digital signal processor for creation of decompressed audio and portions of said MIDI file to said single digital signal processor for creation of MIDI synthesized music comprises the step of coupling a selected portion of said compressed digital audio file to said single digital signal processor until a predetermined amount of decompressed audio is created.

5. The method for simultaneous output of digital audio and MIDI synthesized music according to claim 1, wherein said step of selectively and alternatively coupling portions of said compressed digital audio file to said single digital signal processor for creation of decompressed audio and portions of said MIDI file to said single digital signal processor for creation of MIDI synthesized music comprises the step of coupling a selected portion of said MIDI file to said single digital signal processor until a predetermined amount of digitally synthesized music is created.

6. An apparatus for simultaneously outputting digital audio and MIDI synthesized music, said apparatus comprising:
   - first memory means for storing a compressed digital audio file;
   - second memory means for storing a MIDI file;
   - a single digital signal processor;
   - control means for selectively and alternatively coupling said first memory means to said single digital signal processor for creation of decompressed audio and said second memory means to said single digital signal processor for creation of MIDI synthesized music;
   - first buffer means coupled to said single digital signal processor for temporarily storing of decompressed audio;
   - second buffer means coupled to said single digital signal processor for temporarily storing MIDI synthesized music; and
   - additive mixer means coupled to said first buffer means and said second buffer means for creating a composite output including digital audio and MIDI synthesized music.

7. The apparatus for simultaneously outputting digital audio and MIDI synthesized music according to claim 6, further including a digital-to-analog converter coupled to said additive mixer means for converting said composite output to an analog signal.

8. The apparatus for simultaneously outputting digital audio and MIDI synthesized music according to claim 7, further including audio output means coupled to said digital-to-analog converter for outputting said analog signal.

* * * * *

UNITED STATES PATENT AND TRADEMARK OFFICE

CERTIFICATE OF CORRECTION

PATENT NO. : 5,054,360

DATED : Oct. 8, 1991

INVENTOR(S) : Lisle, et al.

It is certified that error appears in the above-identified patent and that said Letters Patent is hereby corrected as shown below:

Column 4, line 22, change "lo" to --10--.

Column 4, line 33, change "We))" to --well--.

Column 4, line 41, after "system" insert --10--.

Column 5, line 37, change "Via" to --via--.

Column 6, line 13, change "56" to --52--.

Signed and Sealed this

Twenty-third Day of February, 1993

*Attest:*

STEPHEN G. KUNIN

*Attesting Officer*

*Acting Commissioner of Patents and Trademarks*